US010028869B2

(12) United States Patent
Egan

(10) Patent No.: US 10,028,869 B2
(45) Date of Patent: Jul. 24, 2018

(54) POWER LIFT SYSTEM AND METHOD

(76) Inventor: Thomas F. Egan, Binghamton, NY (US)

( * ) Notice: Subject to any disclaimer, the term of this patent is extended or adjusted under 35 U.S.C. 154(b) by 0 days.

(21) Appl. No.: 13/137,243

(22) Filed: Jul. 29, 2011

(65) Prior Publication Data

US 2012/0093623 A1 Apr. 19, 2012

Related U.S. Application Data

(60) Provisional application No. 61/344,488, filed on Aug. 5, 2010.

(51) Int. Cl.

*B65F 3/00* (2006.01)
*A61G 3/06* (2006.01)
*A61G 3/02* (2006.01)

(52) U.S. Cl.

CPC ..... *A61G 3/062* (2013.01); *A61G 3/0209* (2013.01)

(58) Field of Classification Search

CPC ..... A61G 3/06
USPC ..... 414/546, 921, 539
See application file for complete search history.

(56) References Cited

U.S. PATENT DOCUMENTS

| | | | | |
|---|---|---|---|---|
| 360,578 | A | | 4/1887 | Francis |
| 2,792,951 | A | | 5/1957 | White |
| 3,516,559 | A | | 2/1970 | Walter |
| 3,710,962 | A | | 1/1973 | Fowler, Jr. |
| 3,896,946 | A | | 7/1975 | Forsyth et al. |
| 4,015,725 | A | | 7/1977 | Ryan et al. |
| 4,075,719 | A | | 2/1978 | Sullivan |
| 4,096,955 | A | | 6/1978 | Dake |
| 4,140,230 | A | | 2/1979 | Pearson |
| 4,142,641 | A | | 3/1979 | Dake |
| 4,170,368 | A | | 10/1979 | Southward |
| 4,226,567 | A | | 10/1980 | Van Orsdale, Jr. |
| 4,270,630 | A | | 6/1981 | Karkau |
| 4,306,634 | A | | 12/1981 | Sangster |
| 4,365,924 | A | | 12/1982 | Brigman et al. |
| 4,398,858 | A | | 8/1983 | Paffrath |
| 4,406,574 | A | | 9/1983 | Riley |
| 4,420,286 | A | | 12/1983 | Hanson et al. |
| 4,438,640 | A | | 3/1984 | Willis |
| 4,458,870 | A | * | 7/1984 | Duncan et al. ..... 248/279.1 |
| 4,483,653 | A | | 11/1984 | Waite |
| 4,545,085 | A | | 10/1985 | Feldt |

(Continued)

FOREIGN PATENT DOCUMENTS

| | | |
|---|---|---|
| DE | 3123546 | 1/1983 |
| GB | 2322352 | 8/1998 |

(Continued)

OTHER PUBLICATIONS

Bruno Independent Living Aids, Inc., Operator/Installation Manual; 2001.

*Primary Examiner* — Saul Rodriguez
*Assistant Examiner* — Willie Berry, Jr.

(57) ABSTRACT

A power lift system and method are disclosed. In one particular exemplary embodiment, the power lift system and method may be realized as a power lift and transfer system. The power lift and transfer system may move, stow, and carry a mobility device for a user with a disability. The power lift and transfer system may further transport the mobility device in and out of a vehicle from a position adjacent to a user or on top of the vehicle to passenger or driver areas of the vehicle.

18 Claims, 6 Drawing Sheets

(56) References Cited

U.S. PATENT DOCUMENTS

| | | | |
|---|---|---|---|
| 4,551,060 | A | 11/1985 | Quercy |
| 4,569,094 | A | 2/1986 | Hart et al. |
| 4,573,854 | A | 3/1986 | McFarland |
| 4,605,132 | A | 8/1986 | Van Seumeren |
| 4,616,972 | A | 10/1986 | McFarland |
| 4,644,595 | A | 2/1987 | Daniel |
| 4,659,276 | A | 4/1987 | Billett |
| 4,661,035 | A | 4/1987 | Danielsson |
| 4,664,584 | A | 5/1987 | Braun et al. |
| 4,671,729 | A | 6/1987 | McFarland |
| 4,685,860 | A | 8/1987 | McFarland |
| 4,786,072 | A | 11/1988 | Girvin |
| 4,797,042 | A | 1/1989 | McFarland |
| 4,801,237 | A | 1/1989 | Yamamoto |
| 4,808,056 | A | 2/1989 | Oshima |
| 4,809,998 | A | 3/1989 | Girvin |
| 4,955,779 | A | 9/1990 | Knackstedt |
| 4,974,766 | A | 12/1990 | DiPalma et al. |
| 5,022,106 | A | 6/1991 | Richards |
| 5,035,467 | A | 7/1991 | Axelson et al. |
| 5,040,832 | A | 8/1991 | Zalewski |
| 5,102,195 | A | 4/1992 | Axelson et al. |
| 5,154,563 | A | 10/1992 | Phillips |
| 5,160,236 | A | 11/1992 | Redding et al. |
| 5,180,275 | A | 1/1993 | Czech et al. |
| 5,193,633 | A | 3/1993 | Ezenwa |
| 5,201,377 | A | 4/1993 | Wilson |
| 5,205,697 | A | 4/1993 | Getty et al. |
| 5,261,779 | A | 11/1993 | Goodrich |
| 5,308,214 | A | 5/1994 | Crain et al. |
| 5,333,333 | A | 8/1994 | Mah |
| 5,348,172 | A | 9/1994 | Wilson |
| 5,375,913 | A | 12/1994 | Blanchard |
| 5,431,526 | A | 7/1995 | Peterson et al. |
| 5,456,335 | A | 10/1995 | Kinsey |
| 5,456,568 | A | 10/1995 | Kirby et al. |
| 5,459,891 | A | 10/1995 | Reeve et al. |
| 5,467,813 | A | 11/1995 | Vermaat |
| 5,502,851 | A | 4/1996 | Costello |
| 5,520,403 | A | 5/1996 | Bergstrom et al. |
| 5,540,539 | A | 7/1996 | Wolfman et al. |
| 5,542,811 | A | 8/1996 | Vartanian |
| 5,560,054 | A | 10/1996 | Simon |
| 5,617,963 | A | 4/1997 | Baziuk et al. |
| 5,639,105 | A | 6/1997 | Summo |
| 5,649,329 | A | 7/1997 | Horcher et al. |
| 5,682,630 | A | 11/1997 | Simon |
| 5,746,563 | A | 5/1998 | Steckler |
| 5,827,036 | A | 10/1998 | Steffes et al. |
| 5,845,348 | A | 12/1998 | Dunn et al. |
| 5,857,832 | A | 1/1999 | Al-Temen et al. |
| 5,987,664 | A | 11/1999 | Somerton et al. |
| 6,026,523 | A | 2/2000 | Simon et al. |
| 6,039,402 | A | 3/2000 | Nemoto |
| 6,042,330 | A | 3/2000 | Egan |
| 6,223,364 | B1 | 5/2001 | Egan |
| 6,260,218 | B1 | 7/2001 | Tsuga |
| 6,283,528 | B1 | 9/2001 | Townsend |
| 6,289,534 | B1 | 9/2001 | Hakamiun et al. |
| 6,367,103 | B1 | 4/2002 | Collins |
| 6,461,097 | B1 * | 10/2002 | Ablabutyan ..... A61G 3/06 414/546 |
| 6,595,738 | B2 | 7/2003 | Rock et al. |
| 6,612,615 | B1 | 9/2003 | Dimand |
| 6,612,802 | B2 | 9/2003 | Egan |
| 6,682,291 | B2 | 1/2004 | Schatzler et al. |
| 6,739,642 | B1 | 5/2004 | Egan |
| 6,823,541 | B2 | 11/2004 | Egan |
| 7,207,765 | B1 | 4/2007 | Egan |
| 7,284,944 | B1 | 10/2007 | Schlangen |
| 7,383,107 | B2 | 6/2008 | Fehr |
| 7,402,019 | B2 | 7/2008 | Alexander |
| 7,404,505 | B2 | 7/2008 | Walther |
| 7,543,876 | B1 | 6/2009 | Egan |
| 7,621,365 | B2 | 11/2009 | Egan |
| 7,651,313 | B1 | 1/2010 | Egan |
| 7,862,287 | B2 | 1/2011 | Egan |
| 2006/0045686 | A1 | 3/2006 | Alexander |
| 2006/0087166 | A1 * | 4/2006 | Trippensee et al. ..... 297/338 |
| 2006/0182569 | A1 | 8/2006 | Andersson |
| 2010/0040452 | A1 | 2/2010 | Egan |
| 2012/0091772 | A1 | 4/2012 | Egan |

FOREIGN PATENT DOCUMENTS

| | | |
|---|---|---|
| JP | 11-253492 | 9/1999 |
| JP | 2001315565 | 11/2001 |
| JP | 2004195062 | 7/2004 |
| SU | 1484678 A | 6/1989 |

* cited by examiner

POWER LIFT SYSTEM AND METHOD

CROSS-REFERENCE TO RELATED APPLICATIONS

This patent application claims priority to U.S. Provisional Patent Application No. 61/344,488, filed Aug. 5, 2010, which is hereby incorporated by reference herein in its entirety.

FIELD OF THE DISCLOSURE

The present disclosure relates generally to systems and methods for lifting and transferring wheeled mobility devices for persons with disabilities and persons with disabilities into and out of vehicles and, more particularly, to a power lift system and method for assisting persons in lifting and transferring a wheeled mobility device when entering and exiting a vehicle, as well as a conveyor and support system for facilitating persons with disabilities into and out of a vehicle.

BACKGROUND OF THE DISCLOSURE

Users with disabilities who wish to travel using a wheelchair or other wheeled mobility device, but who do not have a vehicle which allows for easy stowage of the mobility device, often encounter problems. For example, vehicles such as minivans and full-sized vans with large cargo doors, pickup trucks with large access cabs or cargo boxes, and SUV's benefit from large and logical wheelchair storage areas, several of which are located conveniently close to the seating area which individuals with disabilities may need to access. Preferably, with such vehicles, there is a minimum of distance between where a wheelchair may be stowed and the destination of the individual inside the vehicle. For reasons of fuel economy, personal choice, and/or comfort, many wheelchair or mobility-impaired persons who are unable to, or for whom it is unsafe to, walk to the rear of a vehicle from a passenger or driver's door, will desire access to vehicles with severe space constraints. These persons may nevertheless wish to store either a power or manual wheelchair or other personal mobility aid such as a walker with the vehicle. In vehicles with severe space constraints, this may mean that the only logical place to store a mobility device is in an area adjacent to the seat in which the user plans to sit. Although some lifts exist which allow a user to store a mobility device in an area adjacent to the seat in which the user plans to sit, such as the area inside the mid position sliding door of a van or the area to the rear of the front seats of an extended-cab pickup truck, the majority of those lifts have two drawbacks. First, they do not allow for stowage of the mobility device in a 90-degree rotated position (the majority of wheeled personal mobility devices are longer than they are tall, thus causing the overall footprint of mobility device plus device to be more significant), and the mechanism is generally behind the wheelchair, which protrudes into the area of the adjacent seat, most often causing the loss of seating capacity of one person or more. In addition, the fact that alternative devices require a larger drive mechanism, typically a telescopic or parallel-arm arrangement moving atop a sliding track, contrasts sharply with the more advantageous configuration of the apparatus disclosed herein, which has a single drive mechanism featuring a belt drive (recognized to be the drive mechanism with the greatest differential between extended and retracted positions thus the most compact in the stowed/retracted position), located underneath the mobility device when in the stowed position. Alternative devices which offer the smallest footprint such as the Speedy Lift from Adapt Solutions have the disadvantage of having a docking device which requires the wheelchair to be stowed in the unfolded position, which typically requires the wheelchair width dimensions to be less than the available door opening width. The duckbill/blade style docking device of the apparatus disclosed herein has no such restriction due to its location on a single side of the wheelchair. Some lifts such as the Braun Chairtopper do exist which allow both for stowage of a wheelchair on a rooftop and delivery of same to a driver's or passenger's door. However, many users have reservations about such technology as rooftop devices often compromise appearance, fuel economy, handling, and stability of the vehicle.

In view of the foregoing, it may be understood that there may be significant problems and shortcomings associated with current mobility assistance systems.

SUMMARY OF THE DISCLOSURE

A power lift system and method are disclosed. In one particular exemplary embodiment, the power lift system and method may be realized as a power lift and transfer system. The power lift and transfer system may move, stow, and carry a mobility device for a user with a disability. The power lift and transfer system may further transport the mobility device in and out of a vehicle from a position adjacent to a user or on top of the vehicle to passenger or driver areas of the vehicle.

The present disclosure will now be described in more detail with reference to exemplary embodiments thereof as shown in the accompanying drawings. While the present disclosure is described below with reference to exemplary embodiments, it should be understood that the present disclosure is not limited thereto. Those of ordinary skill in the art having access to the teachings herein will recognize additional implementations, modifications, and embodiments, as well as other fields of use, which are within the scope of the present disclosure as described herein, and with respect to which the present disclosure may be of significant utility.

BRIEF DESCRIPTION OF THE DRAWINGS

In order to facilitate a fuller understanding of the present disclosure, reference is now made to the accompanying drawings, in which like elements are referenced with like numerals. These drawings should not be construed as limiting the present disclosure, but are intended to be exemplary only.

DETAILED DESCRIPTION OF EXEMPLARY EMBODIMENTS

Figure 3A:
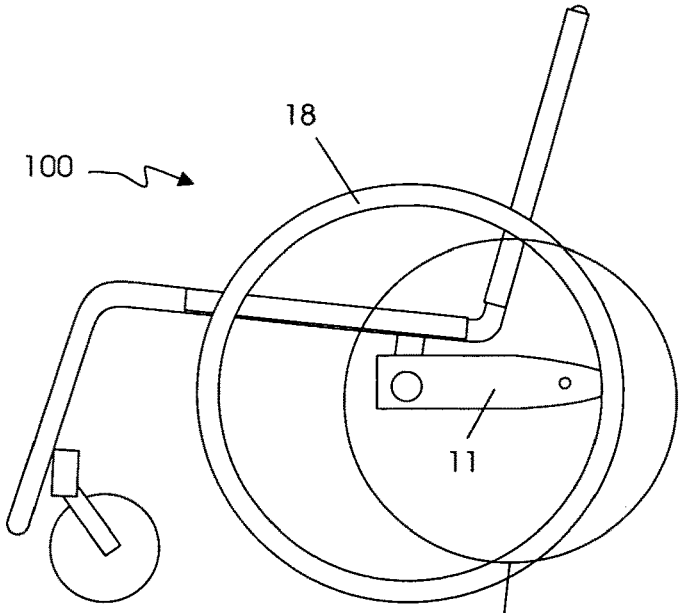
FIGS. 3*a* and 3*b* are a detail view of a duckbill/blade docking device referred to in FIGS. 1*a* and 2 in accordance with an embodiment of the present disclosure.
Figure 3B:
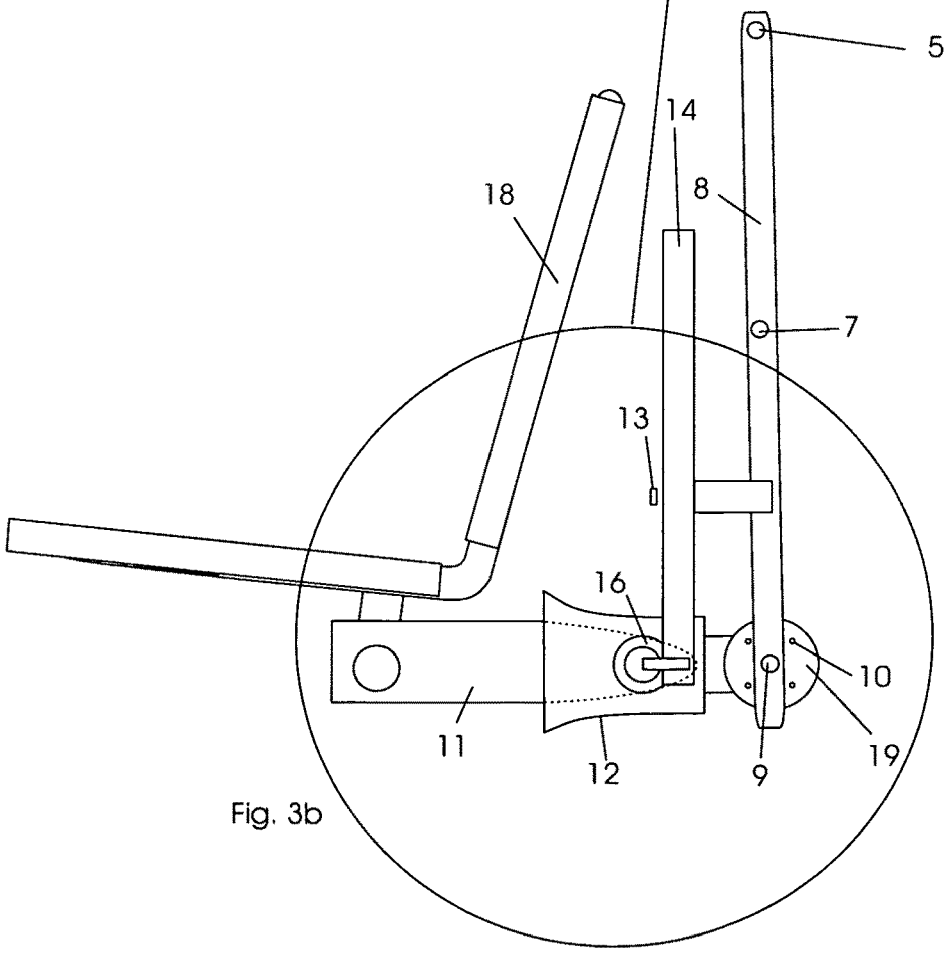
Figure 4:
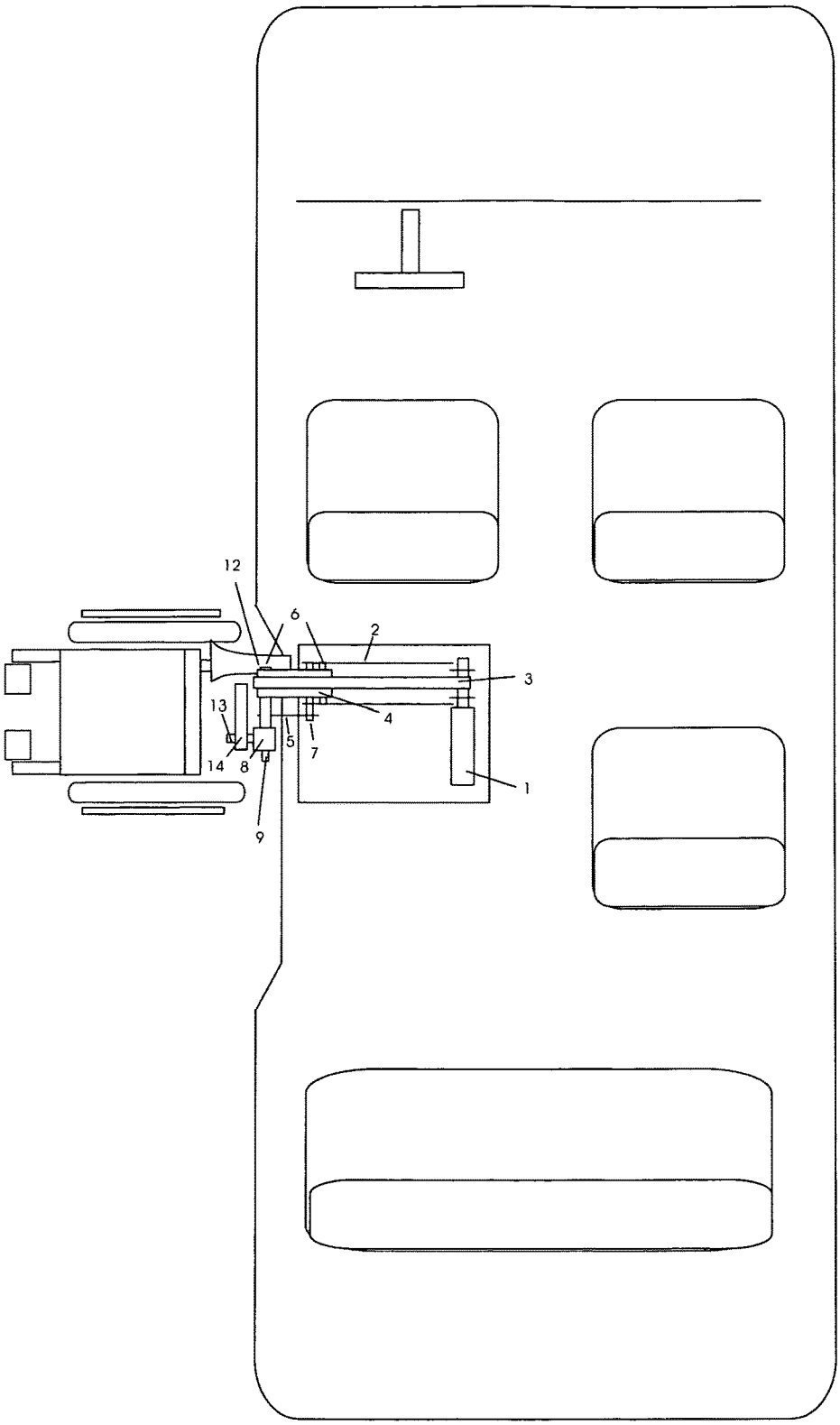
FIG. 4 is a top view of a power lift in accordance with an embodiment of the present disclosure with a wheelchair, in a fully deployed position, installed in a typical vehicle application.

During typical operation of power lift system 100, during the attachment and stowage process, wheelchair 18 is attached to duckbill docking device 12 via blade 11. Although wheelchair 18 is depicted as a manually-operated wheelchair, it may be any personal mobility device designed to assist a person with a disability. Duckbill docking device 12 firmly locks and engages blade 11 via locking pin 16, which is firmly attached to duckbill docking device 12. The end of duckbill docking device 12 is flared for the purpose of facilitating and guiding entry of docking blade 11 from a variety of potential entry angles. A side of docking blade 11 that points toward duckbill docking device 12 is also beveled and curved for the purpose of facilitating and guiding entry of docking blade 11 from a variety of potential entry angles. Similarly, locking pin 16 is beveled on the surface that faces the flared opening of duckbill docking device 12 such that when inward pressure from the leading edge of docking blade 11 is applied, locking pin 16 is pushed aside until the blade is fully entered into and secured in duckbill docking device 12 and locking pin 16 enters the hole in docking blade 11 as shown in FIG. 3*a*. Since the end of the pin that faces away from the flared opening is flat and not beveled, the docking blade 11 and thus the wheelchair 18 are both securely fastened once the locking pin 16 engages in the docking blade's hole until released by the release lever 14.

Duckbill docking device 12 is firmly attached to intermediary support arm 8 via two adjustment plates 19. Adjustment plates 19 are secured to one another via bolts 10, which may be inserted in a number of holes or slots in one another so as to provide a variety of rotational positions which permit docking blade 11 to freely enter duckbill docking device when the power lift system 100 is in a fully deployed position.

Figure 1A:
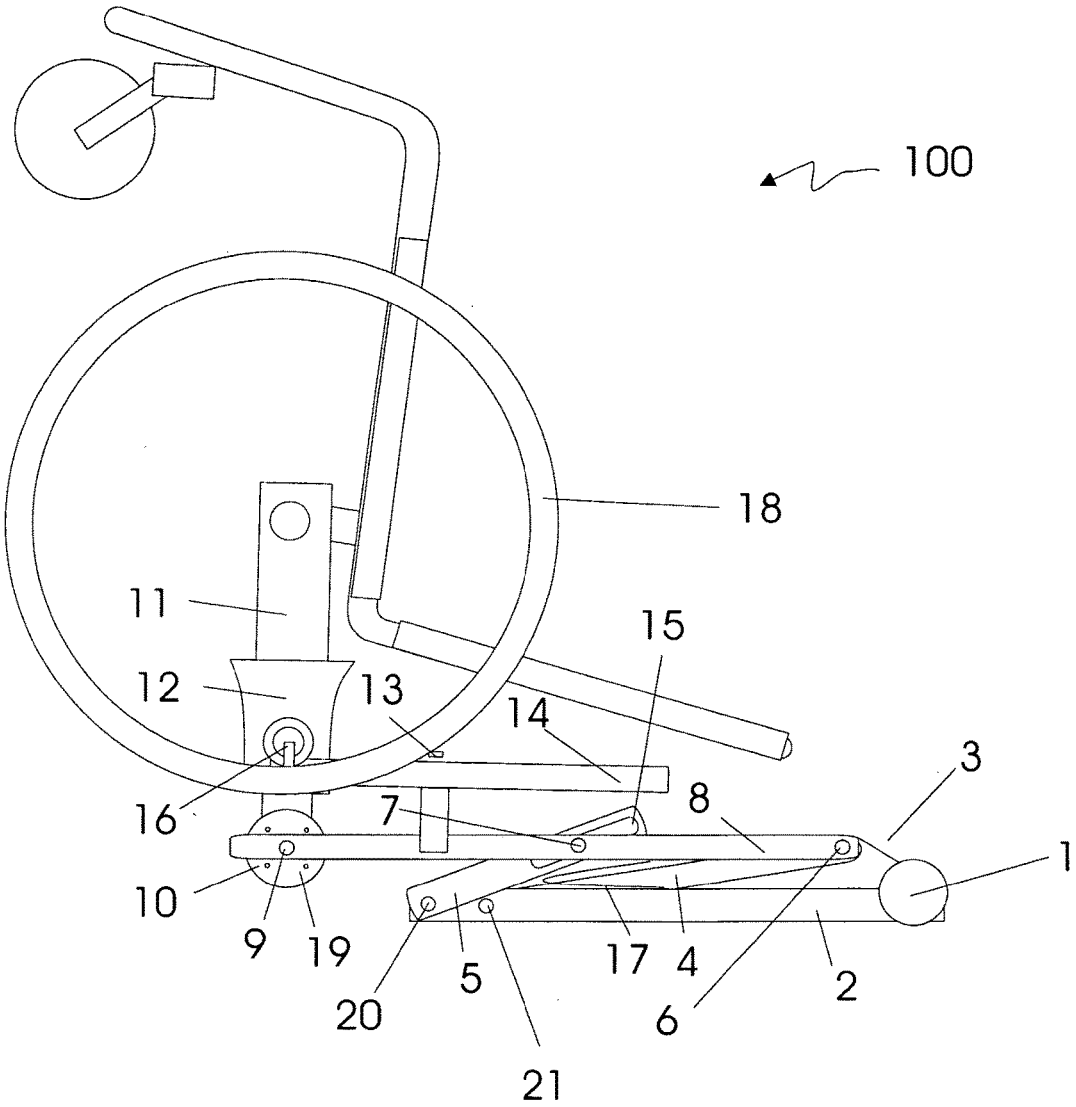
FIG. 1*a* is a side view of a power lift in accordance with an embodiment of the present disclosure with a wheelchair in a fully stowed position inside a vehicle utilizing a duckbill/blade docking device, the blade portion of which is as detailed in FIGS. 3*a* and 3*b*.
Figure 1B:
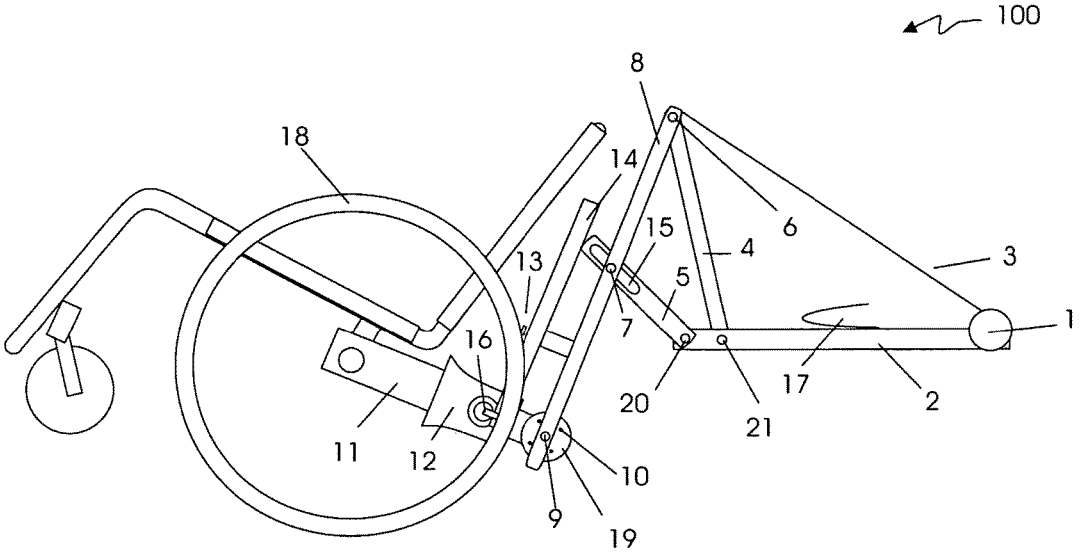
FIG. 1*b* is a side view of a power lift in accordance with an embodiment of the present disclosure with a wheelchair lifted and in a partially stowed position.
Figure 1C:
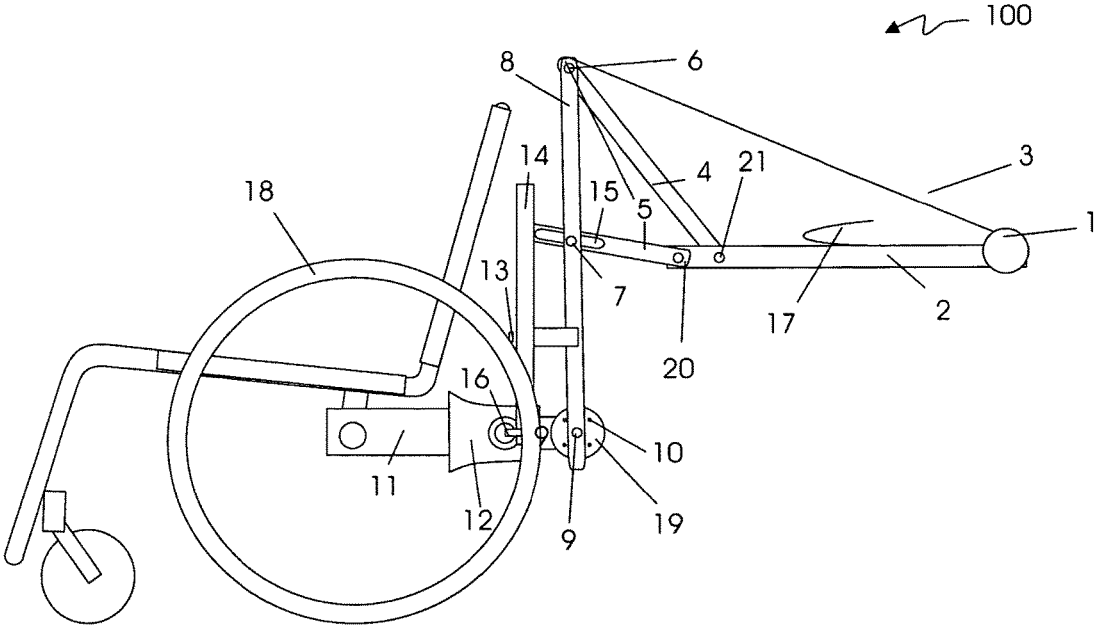
FIG. 1*c* is a side view of a power lift in accordance with an embodiment of the present disclosure with a wheelchair lifted and in a fully deployed position.
Figure 2:
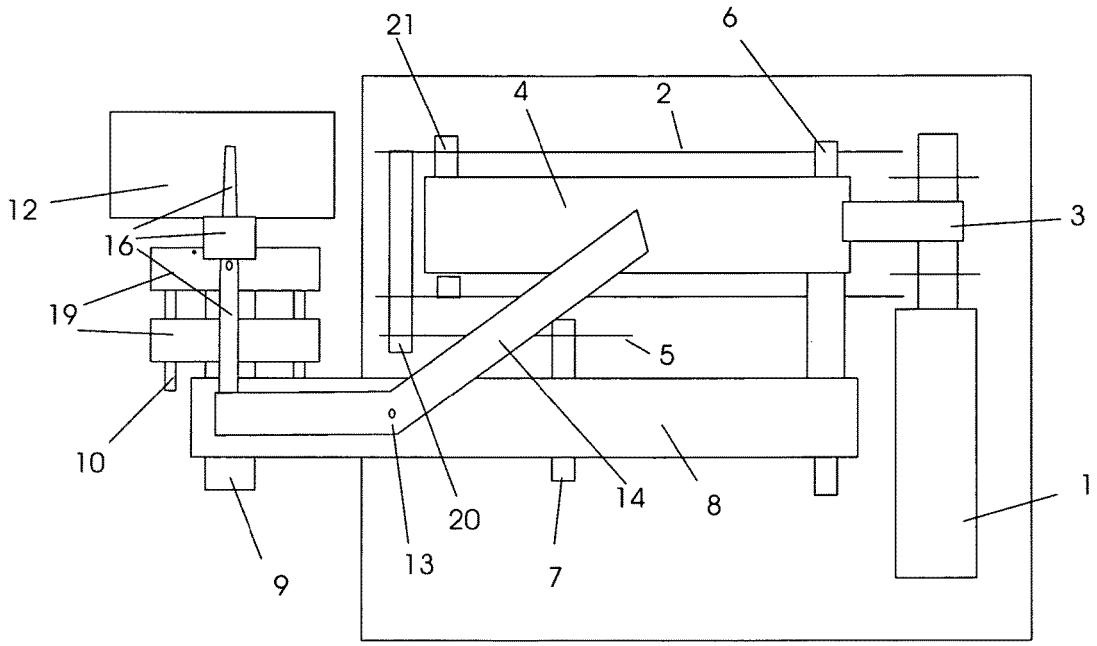
FIG. 2 is a top view of a power lift in accordance with an embodiment of the present disclosure without a wheelchair, in a fully stowed position inside a vehicle showing a duckbill portion of a duckbill/blade docking device, a blade portion of which is as detailed in FIGS. 3*a* and 3*b*.

Although not explicitly shown, an additional set of adjustment plates 19 may be added in a position rotated 90 degrees about a substantially vertical axis (as adjustment plates 19 are oriented in FIG. 1*c*) to allow adjustment of duckbill docking device 12 in multiple axes.

The adjustment plate 19 located farthest from duckbill docking device 12 is firmly attached to intermediary support arm 8. Latch release lever 14 pivots about pivot point 12 and is connected to latch 16 in such a manner that pulling or pushing latch release lever 14 releases latch 16, allowing engagement or disengagement of docking blade 11 from duckbill docking device 12.

Intermediary support arm 8 is pivotally attached to linkage arms 4 and 5 through pivot points 6 and 7, respectively. Depending on the physical constraints of a vehicle configuration and space constraints, pivot point 7 may be allowed to slide through slot 15 such that at key points in the stowage process, the distance between pivot point 7 and pivot point 20 may decrease, driven by either gravity as the mechanism and wheelchair rises and gravity pulls on the wheelchair, forcing pivot point 7 closer to pivot point 20, or by an electrically, hydraulically, or other powered drive mechanism which controls the distance between these two points.

Linkage arms 4 and 5 are pivotally attached to mounting support 2 through pivot points 21 and 20, respectively. Linkage arms 4 and 5 are of substantially dissimilar lengths for the purpose of creating rotation as the wheelchair 18 is stowed inside a vehicle such that the wheelchair 18, when stowed, is in a 90-degree rotated position from its original position when in contact with the ground outside the vehicle.

Mounting support 2 also is firmly attached to drive motor spool assembly 1, which comprises a drive motor and spool suitable for pulling or releasing drive belt 3. Drive motor spool assembly 1 may be electric, hydraulic, or any other means of actuation. Thus, when drive motor spool assembly 1 is activated, it pulls intermediary support arm 6, creating a simultaneous lifting and rotational motion suitable for lifting and rotating wheelchair 18 in to a stowed position inside the vehicle.

In accordance with an embodiment of the present disclosure, to stow wheelchair 18 when the mechanism is initially in the stowed position, a user may activate drive motor spool assembly 1, which ejects the mechanism outward and downward until the duckbill docking device 12 is vertically aligned with docking blade 11, mounted on wheelchair 18. The user may then maneuver the wheelchair 18 to direct docking blade 11 at duckbill docking device 12, which then moves wheelchair 18 rearward. Once docking blade 11 has fully entered duckbill docking device 12, the locking pin 16 may engage in the hole of docking blade 11. The user may then activate drive motor spool assembly 1, which may pull on belt 3 to pull the mechanism inward and upward, causing wheelchair 18 to enter the vehicle and rotate approximately 90 degrees.

To deploy wheelchair 18, the user may activate drive motor spool assembly 1 in the opposite direction, which may eject the mechanism outward and downward until wheelchair 18 touches the ground outside the vehicle. Once the wheelchair 18 has reached the ground outside, the user may then operate release lever 14 in such a direction as to disengage locking pin 16, then pushes wheelchair 18 outward to release it.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

The invention claimed is:

1. A power lift system comprising:

a first linkage arm connected via a first pivoting joint to a fixed base at a first location on the fixed base, wherein the first pivoting joint is configured to allow the first linkage arm to pivot about a first axis;

a second linkage arm connected via a second pivoting joint to the fixed base at a second location on the fixed base, wherein the second pivoting joint is configured to allow the second linkage arm to pivot about a second axis, wherein the first location and the first axis are displaced from the second location and the second axis of a longitudinal axis of the fixed base, wherein the longitudinal axis of the fixed base is substantially perpendicular to the first axis and the second axis;

a support arm connected via a third pivoting joint to the first linkage arm at a third location on the first linkage arm and connected via a fourth pivoting joint to the second linkage arm at a fourth location on the second linkage arm, wherein the third pivoting joint is configured to allow the support arm to pivot about a third axis, wherein the fourth pivoting joint is configured to allow the support arm to pivot about a fourth axis, wherein the third location and the third axis are displaced from the fourth location and the fourth axis along a longitudinal axis of the support arm, wherein the longitudinal axis of the support arm is substantially perpendicular to the third axis and the fourth axis, wherein the first linkage arm has a slot configured to allow the third pivoting joint to travel within the slot;

an adjustable-angle joint connected to the support arm; and a docking device connected to the adjustable-angle joint for securing a personal mobility device.

2. The system of claim 1, wherein the first linkage arm and the second linkage arm have differing lengths.

3. The system of claim 1, wherein the slot is located at a first end of the first linkage arm.

4. The system of claim 1, wherein the third pivoting joint is located at a substantial midpoint of the support arm.

5. The system of claim 1, wherein the docking device comprises a duckbill receiver connected to the adjustable-angle joint, wherein the duckbill receiver comprises a locking pin for engaging a docking blade of a personal mobility device and a release lever for transitioning the locking pin between a locked position and a release position with respect to the engagement of the docking blade, wherein a surface of the locking pin is beveled to facilitate engaging the docking blade.

6. The system of claim 5, wherein a side of the docking blade is beveled to facilitate engaging the locking pin.

7. The system of claim 5, wherein the locking pin is located substantially inside the duckbill receiver.

8. The system of claim 7, wherein an end of the duckbill receiver is flared to facilitate engagement of the docking blade with the locking pin inside the duckbill receiver.

9. The system of claim 5, wherein the release lever is connected to the support arm via a fifth pivoting joint.

10. The system of claim 1, wherein the adjustable-angle joint is adjustable in a plurality of rotational positions.

11. The system of claim 1, further comprising a drive assembly connected to the second linkage arm to control pivoting movement of the at least one of the at least two substantially parallel linkage arms.

12. The system of claim 11, wherein the drive assembly is connected to the second linkage arm via a drive belt.

13. The system of claim 11, wherein the drive assembly is connected to the fixed base.

14. The system of claim 1, wherein the fixed base is securely connected to a floor of a vehicle.

15. The system of claim 1, wherein the second location is located closer to the drive assembly than the first location along the longitudinal axis of the fixed base.

16. The system of claim 1, wherein the third pivoting joint is located closer to the adjustable-angle joint than the fourth pivoting joint along the longitudinal axis of the support arm.

17. A power lift system comprising:

a first linkage arm connected via a first pivoting joint to a fixed base at a first location on the fixed base, wherein the first pivoting joint is configured to allow the first linkage arm to pivot about a first axis;

a second linkage arm connected via a second pivoting joint to the fixed base at a second location on the fixed base, wherein the second pivoting joint is configured to allow the second linkage arm to pivot about a second axis, wherein the first location and the first axis are displaced from the second location and the second axis along of a longitudinal axis of the fixed base, wherein the longitudinal axis of the fixed base is substantially perpendicular to the first axis and the second axis;

a support arm connected via a third pivoting joint to the first linkage arm at a third location on the first linkage arm and connected via a fourth pivoting joint to the second linkage arm at a fourth location on the second linkage arm, wherein the third pivoting joint is configured to allow the support arm to pivot about a third axis, wherein the fourth pivoting joint is configured to allow the support arm to pivot about a fourth axis, wherein the third location and the third axis are displaced from the fourth location and the fourth axis along a longitudinal axis of the support arm, wherein the longitudinal axis of the support arm is substantially perpendicular to the third axis and the fourth axis;

an adjustable-angle joint connected to the support arm;

a docking device connected to the adjustable-angle joint for securing a personal mobility device; and a drive assembly connected to the second linkage arm to control pivoting movement of the at least one of the at least two substantially parallel linkage arms, wherein the drive assembly is connected to the second linkage arm via a drive belt.

18. The system of claim 17, wherein the first linkage arm has a slot configured to allow the third pivoting joint to travel within the slot.

* * * * *